US006925937B2

(12) United States Patent
Robertson

(10) Patent No.: US 6,925,937 B2
(45) Date of Patent: Aug. 9, 2005

(54) THERMAL GENERATOR FOR DOWNHOLE TOOLS AND METHODS OF IGNITING AND ASSEMBLY

(76) Inventor: Michael C. Robertson, P.O. Box 2499, Burleson, TX (US) 76097

( * ) Notice: Subject to any disclaimer, the term of this patent is extended or adjusted under 35 U.S.C. 154(b) by 147 days.

(21) Appl. No.: 10/397,718

(22) Filed: Mar. 26, 2003

(65) Prior Publication Data

US 2005/0072568 A1 Apr. 7, 2005

Related U.S. Application Data

(63) Continuation-in-part of application No. 09/955,686, filed on Sep. 19, 2001, now Pat. No. 6,598,679.

(51) Int. Cl.[7] ..... E21B 29/02

(52) U.S. Cl. ..... 102/202; 166/297; 166/55; 166/63

(58) Field of Search ..... 166/297, 55, 55.1, 166/63, 65.1; 102/202, 202.1; 149/17, 109.2

(56) References Cited

U.S. PATENT DOCUMENTS 3,076,507 A 2/1963 Sweetman
3,713,636 A 1/1973 Helms et al.
3,804,018 A * 4/1974 Janoski ..... 102/202.1
4,070,970 A 1/1978 Scamaton
4,298,063 A * 11/1981 Regalbuto et al. ..... 166/55
4,352,397 A 10/1982 Christopher
4,424,086 A 1/1984 Christopher
4,464,989 A * 8/1984 Gibson et al. ..... 102/202
4,559,890 A 12/1985 Regalbuto et al.
4,598,769 A 7/1986 Robertson
4,619,318 A 10/1986 Terrell et al.
4,620,591 A * 11/1986 Terrell et al. ..... 166/55
4,967,048 A * 10/1990 Langston ..... 166/55.1
5,435,394 A 7/1995 Robertson
5,700,974 A * 12/1997 Taylor ..... 149/17
6,186,226 B1 2/2001 Robertson

* cited by examiner

*Primary Examiner*—David Bagnell
*Assistant Examiner*—Matthew J. Smith
(74) *Attorney, Agent, or Firm*—Geoffrey A. Mantooth

(57) ABSTRACT

An ignition device for a downhole tool includes a body with a cavity, a thermite material and a resistive element within the cavity. The resistive element, which is heated to the high temperature needed for ignition of the thermite material, has a non-galvanic outer surface at the ignition temperature. A large amount of electrical power is required to reach the ignition temperature, making the device safe and unlikely to accidentally ignite. The device has an electrical connector that is located within a sealed chamber when downhole.

14 Claims, 11 Drawing Sheets

THERMAL GENERATOR FOR DOWNHOLE TOOLS AND METHODS OF IGNITING AND ASSEMBLY

This application is a continuation-in-Part application of Ser. No. 09/955,686, filed Sep. 19, 2001 now U.S. Pat. No. 6,598,679.

FIELD OF THE INVENTION

The present invention relates to ignition devices for downhole tools, such as cutting torches, setting tools, perforating tools, jet cutters, and the like.

BACKGROUND OF THE INVENTION

When completing an oil or gas well, there is a frequent need to penetrate or cut casing or pipe in the borehole. For example, a length of casing may be stuck in the hole, preventing retrieval. To retrieve, or salvage, the casing, a cutting tool is lowered downhole. The cutting tool contains flammable materials that are ignited and produces a flame that cuts the surrounding casing.

The initial ignition of the flammable materials is caused by an electrical initiator. The role of the initiator is to safely ignite only when intended, so as to prevent accidental, or premature, ignition, and to reliably ignite once the tool is downhole and positioned.

In the prior art, a cutting tool may use ignitors or detonators which in turn utilize resistors and black powder. The detonators are also referred to as black powder igniters or flame caps. To initiate the detonator, an electrical current is passed through the resistor, generating heat. When the resistor reaches the ignition temperature of the black powder (400–450° F.), ignition occurs. The detonator is typically placed adjacent to other flammable, or pyrotechnic materials, which are ignited.

The prior art detonators present safety concerns in that accidental detonation can occur. Consequently, the detonators require great care in their use, transporting and shipping. Furthermore, black powder performs inconsistently, depending upon various factors such as downhole conditions and even assembly of the detonator and loading the detonator into the tool. Such inconsistency adversely affects the reliability of the downhole tool.

Therefore, it is desirable to provide an ignition device that is safer and more reliable.

SUMMARY OF THE INVENTION

It is an object of the present invention to provide a new explosive ignition device for a downhole tool that is unlikely to accidentally ignite.

It is a further object of the present invention to provide an ignition device for a downhole tool that performs reliably.

The present invention provides an ignition device for a downhole tool that comprises a body with a cavity therein. A thermite material is located in the cavity. A resistive element is located inside of the cavity and has an outer surface in thermal proximity to the thermite material. The resistive element outer surface is non-galvanic at an ignition temperature of the thermite material.

In accordance with one aspect of the present invention, the resistive element comprises a wire-wound resistor with a coating of ceramic or enamel.

In accordance with another aspect of the present invention, the resistive element comprises a length of nickel-chromium wire.

In accordance with still another aspect of the present invention, the thermite material comprises cupric oxide and aluminum or iron oxide and aluminum.

In accordance with still another aspect of the present invention, the body has first and second ends. The first end has an electrical plug and the second end has an opening that communicates with the cavity and the thermite material therein.

The present invention also provides an ignition assembly for a downhole tool. A first sub has first and second ends and a passage extending between the first and second ends. An ignition device is located in the passage, with the ignition device having a thermite material and a resistive element located so as to be in contact with the thermite material. There is also an electrical plug extending toward the first sub first end. A second sub has an electrical receptacle. The second sub is located in the passage so that the electrical receptacle receives the electrical plug to form an electrical connection. A first seal is formed between the ignition device in the first sub and a second seal is formed between the second sub and the first sub, with the electrical connection between the first and second seals.

In accordance with one aspect of the present invention the electrical plug is a banana plug.

In accordance with another aspect of the present invention a length of detonating cord is located adjacent to the first sub second end. There is at least one intermediate charge interposed between the detonating cord and the first sub second end.

The present invention also provides a method of assembling an ignition assembly for use in a downhole tool. An electrical ignition device is provided having a first end with an electrical plug and a second end with an aperture for the exit of ignition products. A seal is provided around the ignition device. The ignition device is inserted into a first sub so as to form a first seal between the ignition device and the sub. The ignition device is secured within the first sub. A second sub is provided with an electrical receptacle. The second sub is inserted into the first sub so that the receptacle receives the plug and so as to form a second seal between the second sub and the first sub.

In accordance with one aspect of the present invention, the step of inserting the second sub into the first sub further comprises screwing the second sub into the first sub.

The present invention also provides a method of initiating an ignition device on a downhole tool. A tool containing the ignition device is lowered downhole on a conductive wireline. The ignition device contains a thermite material having an ignition point of greater than 900° F. Then, at least 25 watts of electrical power is provided to the wireline and into the resistive element in the ignition device until the thermite material ignites.

The present invention also provides an ignition device for use with a downhole tool. The device has a body with a cavity therein and a thermite material located in the cavity. A high temperature resistive wire element is located inside of the cavity and in contact with the thermite material. A power supply is electrically connected with the resistive wire element. The power supply provides a voltage that is regulated so as to maintain continuity of the resistive wire element and provides electrical power that is between 25 and 75 watts.

DESCRIPTION OF THE PREFERRED EMBODIMENTS

The present invention provides a thermal generator (FIG. 11) for use in a variety of applications, and typically in conjunction with downhole tools in oil and gas wells. The thermal generator is an electrically operated initiator. As such, the thermal generator initiates an exothermic reaction, which propagates heat to an adjacent ignitable material. The secondary material, when ignited, produces the desired high temperature and energy release.

In the description that follows, the thermal generator is described in the context of a radial cutting torch. The thermal generator can also be used in conjunction with setting tools, perforating tools and jet cutters.

Figure 11:
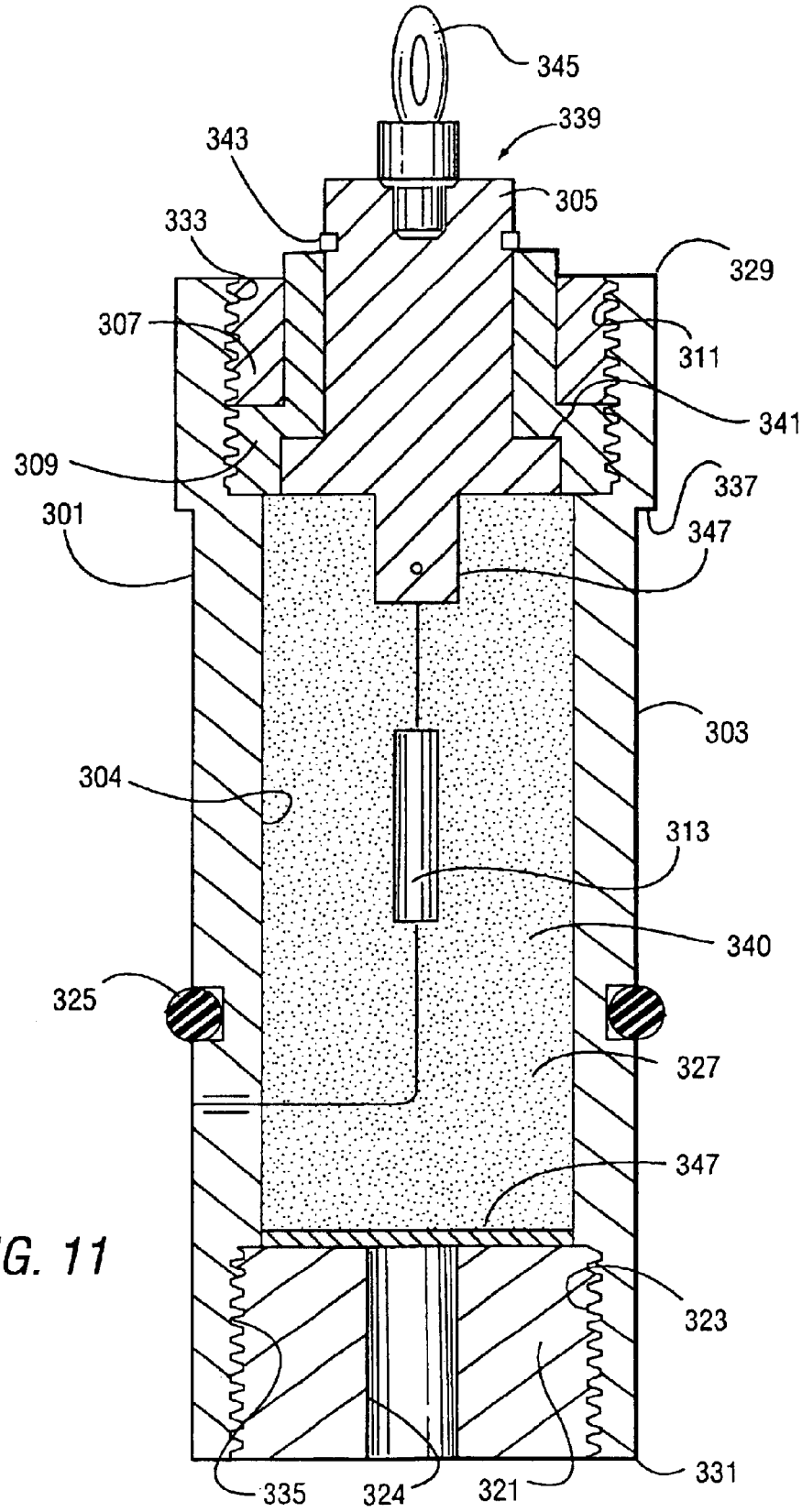
FIG. 11 is a cross-sectional view of the thermal generator in accordance with another embodiment.

The thermal generator of FIG. 11 is used with a conductive wire line. Thus, the initiation current is provided from the surface.

The thermal generator is safe in that the risk of accidental initiation is very low. A flammable material having a high ignition temperature is utilized. Consequently, the energy required to ignite the flammable material is high, making the device very resistant to unintentional initiations. This in turn allows the thermal generator to be more easily shipped and transported. In addition, the thermal generator is safe for use in hazardous environments, offshore oil and gas platforms and drilling sites. The thermal generator is classified as a flammable solid, UN1325, Sec. 4.1. This is unlike black powder ignitors or detonators, which have restrictions on shipping due to their relatively unstable nature.

Also, the thermal generator, once initiated, produces a clean, slag-free burn. This is desirable for downhole tools, which typically route the hot gases produced by the ignitable materials through one or more passageways. Slag can occlude the passageways, resulting in a malfunction or diminished performance.

Figure 13:
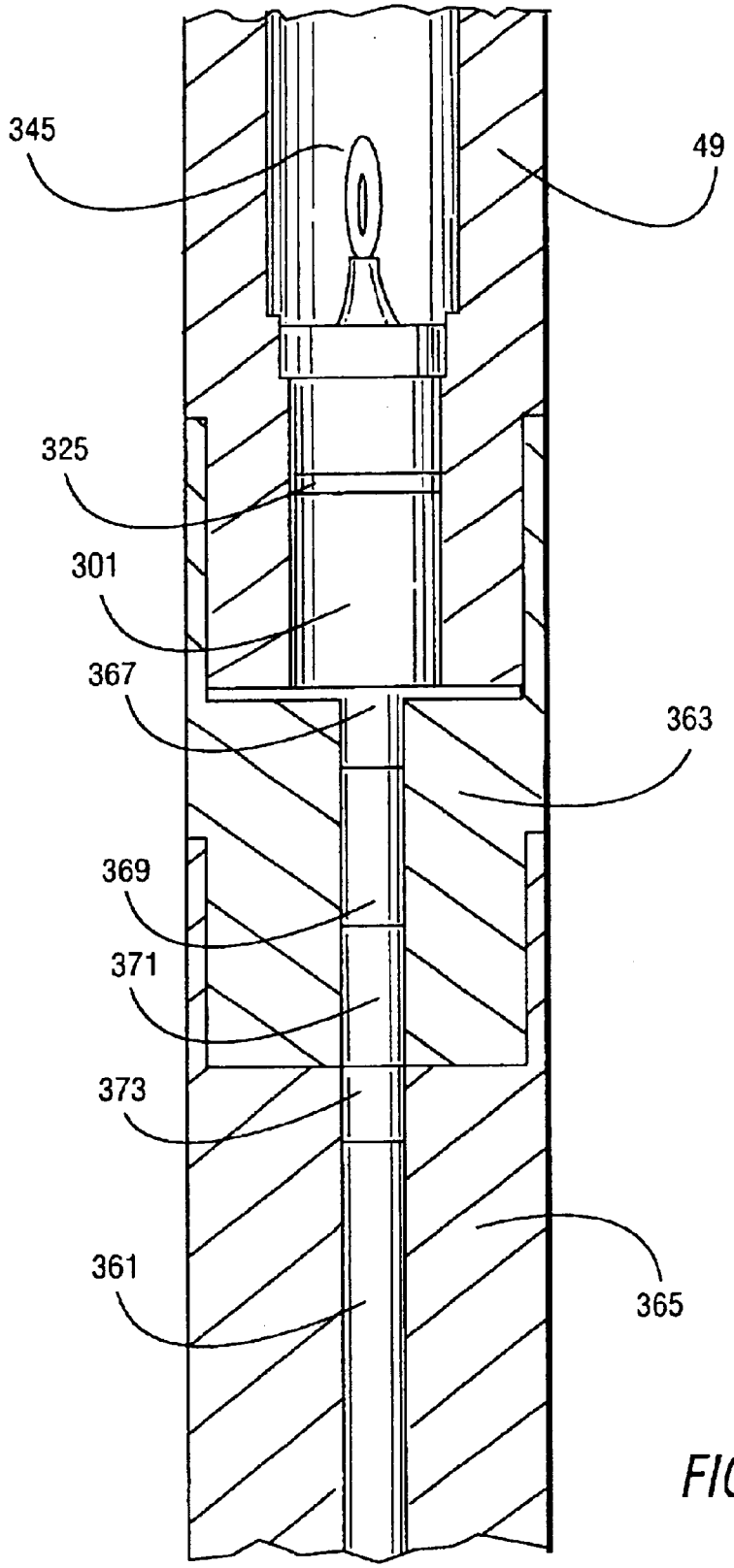
FIG. 13 is a cross-sectional view of thermal generator of FIG. 11, installed in a perforating tool.

The thermal generator can be used to initiate the detonation of detonating cord (See FIG. 13). The subassembly shown in FIG. 13 includes "flash" detonators and converts the flame provided at the output of the thermal generator to an explosion for initiating the detonating cord. The detonating cord can be used in perforating tools, such as guns and explosive cutting tools.

Figure 14:
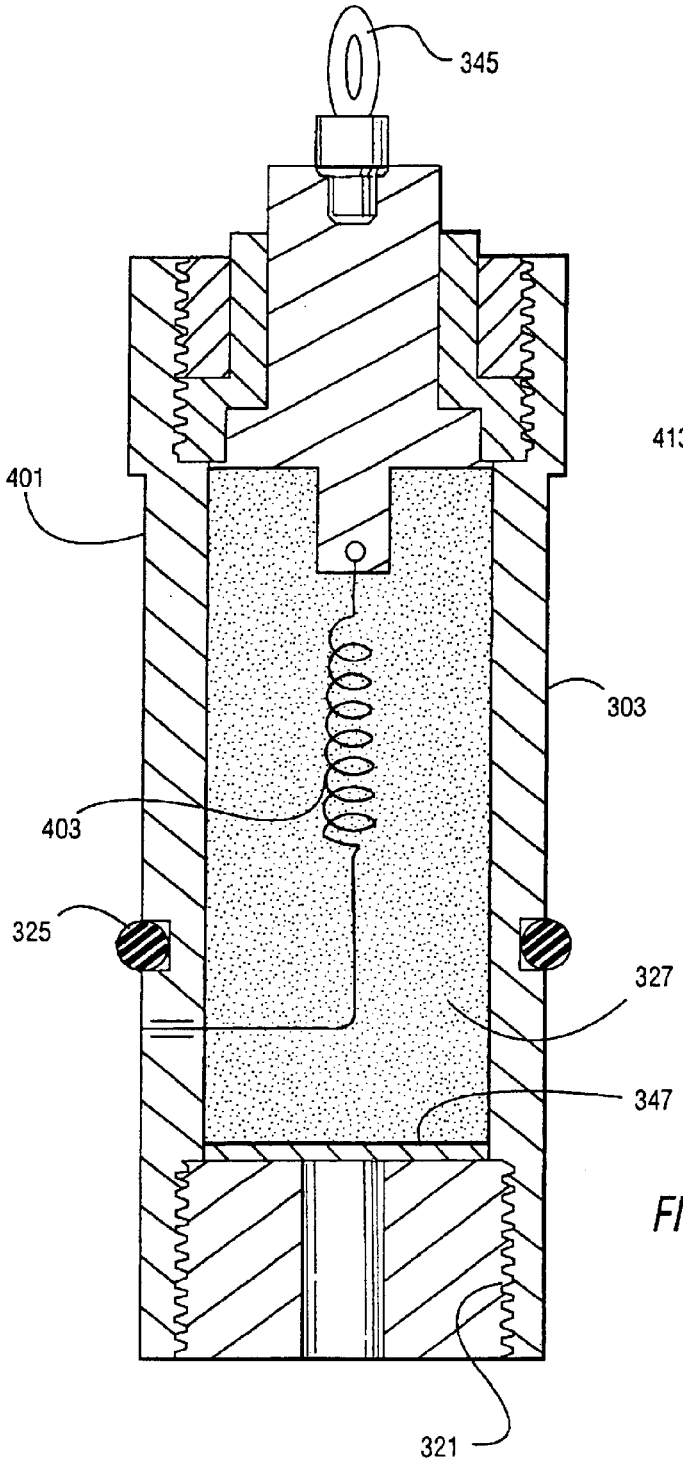
FIG. 14 is a cross-sectional view of the thermal generator, in accordance with another embodiment.

The thermal generator of FIG. 14 is used with a slickline. A slickline typically is a cable without electrically conductive wires The power supply for the thermal generator is thus contained downhole.

Referring now to FIGS. 1, 2A, 2B, and 3 the apparatus or tool of the invention is identified at 21. It comprises an elongated tubular body 23 having an upper ignition end 25 which carries an ignition device, an intermediate section 27 which carries fuel pellets and a nozzle end 29. The tool 21 is adapted to be located in pipe 31 located in a borehole 33 extending into the earth from the surface 35 for severing the pipe. The pipe may be stuck in the borehole and it is desirable to sever the pipe above where it is stuck whereby the upper portion may be removed from the borehole. The pipe may be a drill pipe, production tubing, coiled tubing, casing, etc. The ignition device is actuated to ignite the fuel pellets to create a flame which is applied to a nozzle and diverter in the nozzle end 29 to direct the flame radially out of the tool against the pipe to sever or cut the pipe.

The body 23 comprises two hollow metal cylindrical members 41 and 43 having threads 41T1 and 43T which are screwed together and an upper hollow metal cylindrical member 49 having threads 49T which are screwed threads to 41T2 of member 41. A cable head assembly 51 is coupled to member 49 and a wireline cable 53 is coupled to the upper end of assembly 51 and extends to the surface 35 to apparatus 55 which includes a reel employed for unwinding and winding the cable 53 to lower and raise the apparatus 23. Also provided is an AC or DC source 61 of electrical power for applying electrical power to electrical leads 63 and 65 of the cable 53 when the switch 67 is closed.

The cylindrical members 41 and 43 have cylindrical openings 41(O) and 43(O) extending therethrough. Supported in the openings 41(O) and 43(O) are a plurality of stacked solid fuel pellets 71. The pellets 71 are formed of combustible pyrotechnic material which is pressed together into a pellet of a generally donut or torroid configuration having a central hole 73 formed therethrough. The holes 73 of the pellets 71 are aligned when the pellets 71 are stacked in the openings 41(O) and 43(O). Loose combustible material 75 which may be of the same material as that of the pellets 71 is disposed in the holes 73.

Figure 1:
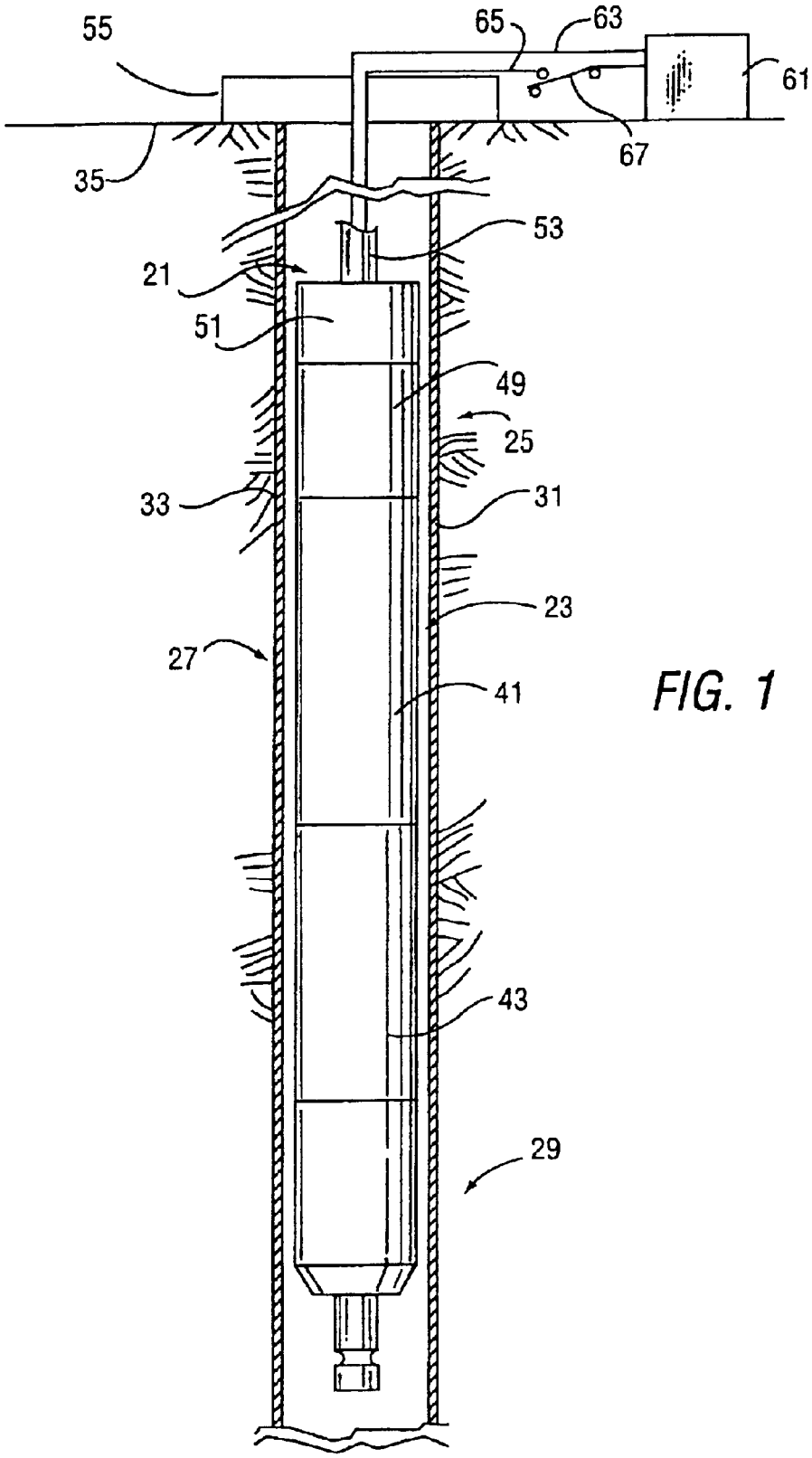
FIG. 1 illustrates the apparatus or tool of the invention in pipe located in a borehole extending from the surface.
Figure 2A:
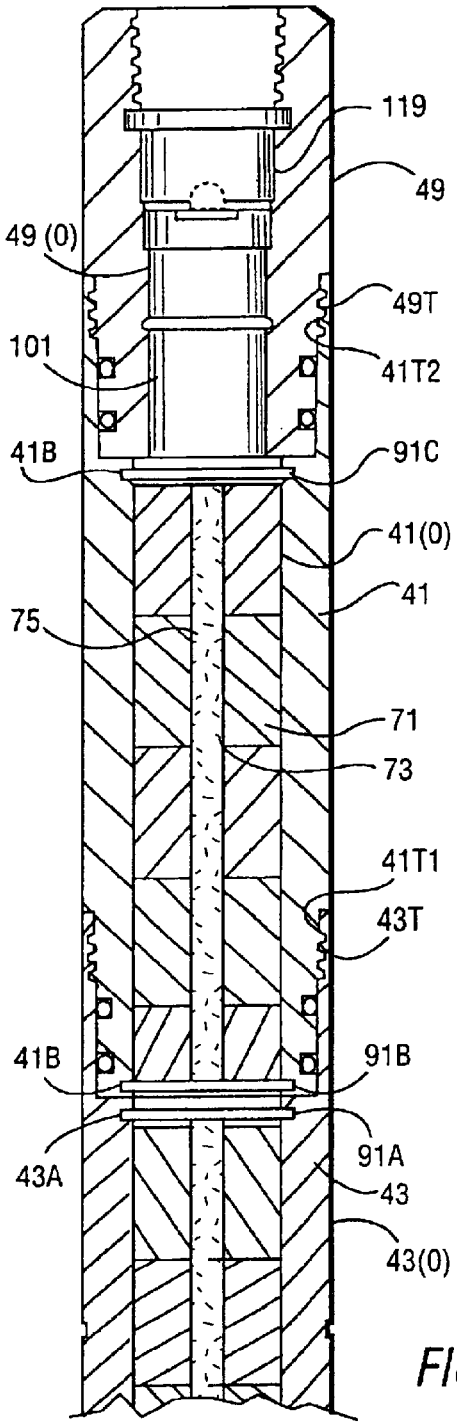
FIGS. 2A and 2B are partial sectional views of the pipe cutting apparatus of the invention. The upper end of the section of FIG. 2B is connected to the lower end of the section of FIG. 2A.
Figure 2B:
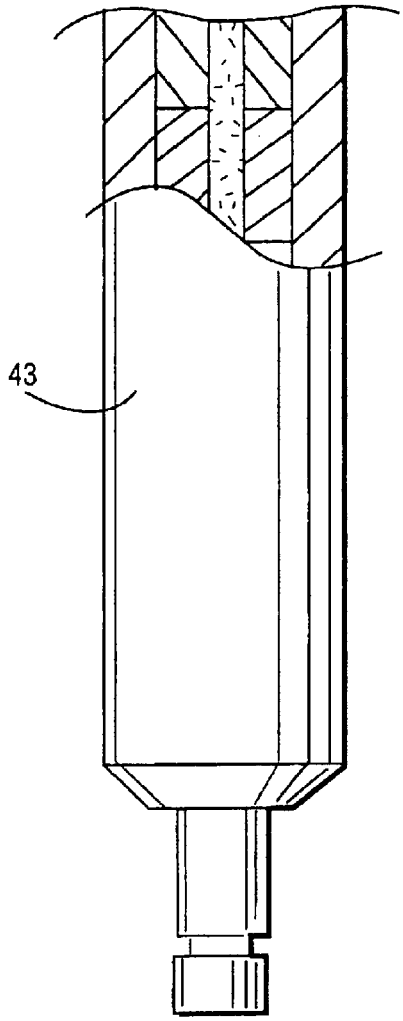

The pellets 71 are held between a lower support 81 and metal snap rings 91A, 91B, and 93C located in grooves 43A, 41A, 41B. The lower support 81 supports the pellets 71 when the tool is in a vertical position as shown in FIGS. 1, 2A, 2B and snap rings 91A, 91B, and 9C prevents the pellets from falling out of the tool in the event the tool is in a horizontal position or its end 25 is lower than end 29.

Figure 9:
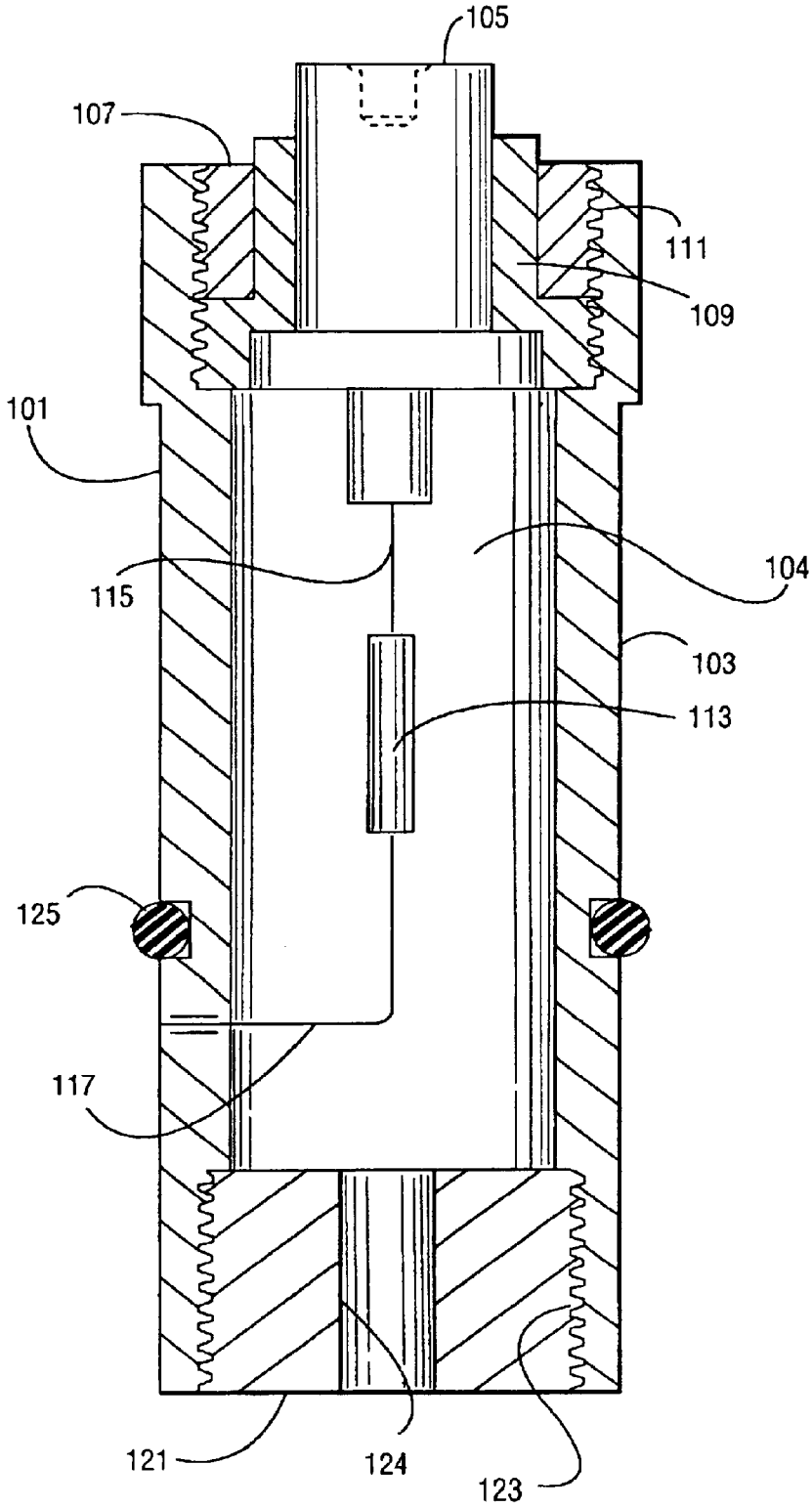
FIG. 9 is a cross-section of the thermal generator of the apparatus, in accordance with one embodiment.

The member 49 has a central opening 49(O) formed therethrough. A thermal generator 101 is located in the opening 49(O) next to the upper pellet 71. Referring also to FIG. 9, the generator 101 comprises an annular metal body 103 with an opening, or passage, 104 formed therethrough. An electrical contact 105 is supported at its upper end, which is supported by a threaded insulator 109 and a threaded ring 107 both of which are screwed to threads 111 formed in the wall of the body 103 at its upper end. The contact 105 is electrically connected to an electrical resistive member 113 by an electrical lead 115. The other end of the resistor 113 is connected to an electrical lead 117 which extends through the wall 103. The contact 105 is connected to a contact located in annular member, or sub, 119. The contacts in member 119 and lead 117 are connected to respective wires 63 and 65 by way of the assembly 51. The body 103 has a threaded bottom port plug 121 having threads which are screwed to threads 123 formed in the wall of member 103 at its lower end. The plug 121 has a central 124 opening formed therethrough for the passage of heat for igniting the material 75 and pellets 71. Member 125 is an O-ring.

The support 81 is formed of carbon and has an annular shoulder 131 to support the pellets. The support 81 has a thin annular upper wall 133 that extends down to the annular shoulder 131 which has a central opening 135 formed therethrough. The lowest pellet 71 is supported by the shoulder 131 with the other pellets 71 stacked on top of each other. The lower edge of the shoulder 131 flares downward and outwards at 137 to a lower edge 139 which is supported by the upper end of a shield 161. The support 81 acts as a spacer which spaced the pellets 71 from the lower components and defines a mixing cavity 153 between upper and lower planes 153U and 153L and which is in the form of a truncated cone having a cone shaped side wall 137.

The lower components of the tool comprises a carbon shield 161, a metal nozzle 201, a carbon retainer 221, and a carbon diverter 231.

The shield 161 has an annular upper wall 183 with an upper end 185 that supports the lower edge 139 of the member 81. It extends down to an annular flat upper wall 187 from which an upward extending cone 189 extends. The shield 161 has a flat lower end 191. A plurality of spaced apart apertures 193 are formed through the wall portion 187 and end 191 around the axis of the cone 189 and the axis of the tool.

The nozzle 201 has a plurality of apertures 203 formed therethrough which are lined with carbon tubes 205 having a plurality of apertures 207. Each aperture 207 is aligned with an aperture 193. The nozzle 201 has a shaft 209 fixedly coupled thereto which extends downward from its lower surface 211. The shaft 209 has threads 213 at its lower end.

A carbon retainer 221 has a central aperture 223 formed therethrough and a plurality of spaced apart apertures 225 formed therethrough with each aperture 223 aligned with an apertures 207, such that a plurality of sets of aligned apertures 191, 207, 225 are formed. The retainer 221 has a lower outer annular wall 227 which extends downward to the lower level of the wall 43 such that the end 227E of the wall 227 forms a plane with the lower end 43E of the wall 43.

The diverter 231 has a surface 233 which flares and curves downward and outward from a small annular circumference at 235 to a larger annular circumference at 237 defining half of a hyperboloid.

The wall 227, the diverter surface 233 and the lower wall 227 of the retainer 221 form an annular chamber or cavity 241 into which hot gases from the nozzle aperture flow. The chamber 241 has an annular outlet gap 243.

The diverter 231 also has a central aperture 245. The nozzle shaft 209 extends through the diverter aperture 245 and is screwed to an anchor connector 247 having a wide annular shaped upper end 249. The lower end 251 of the diverter 231 abuts against the upper end 253 of the anchor connector 247. The shaft 209 is screwed into an aperture 251 of the anchor connector 247 and holds the diverter 231 in place.

Figure 3:
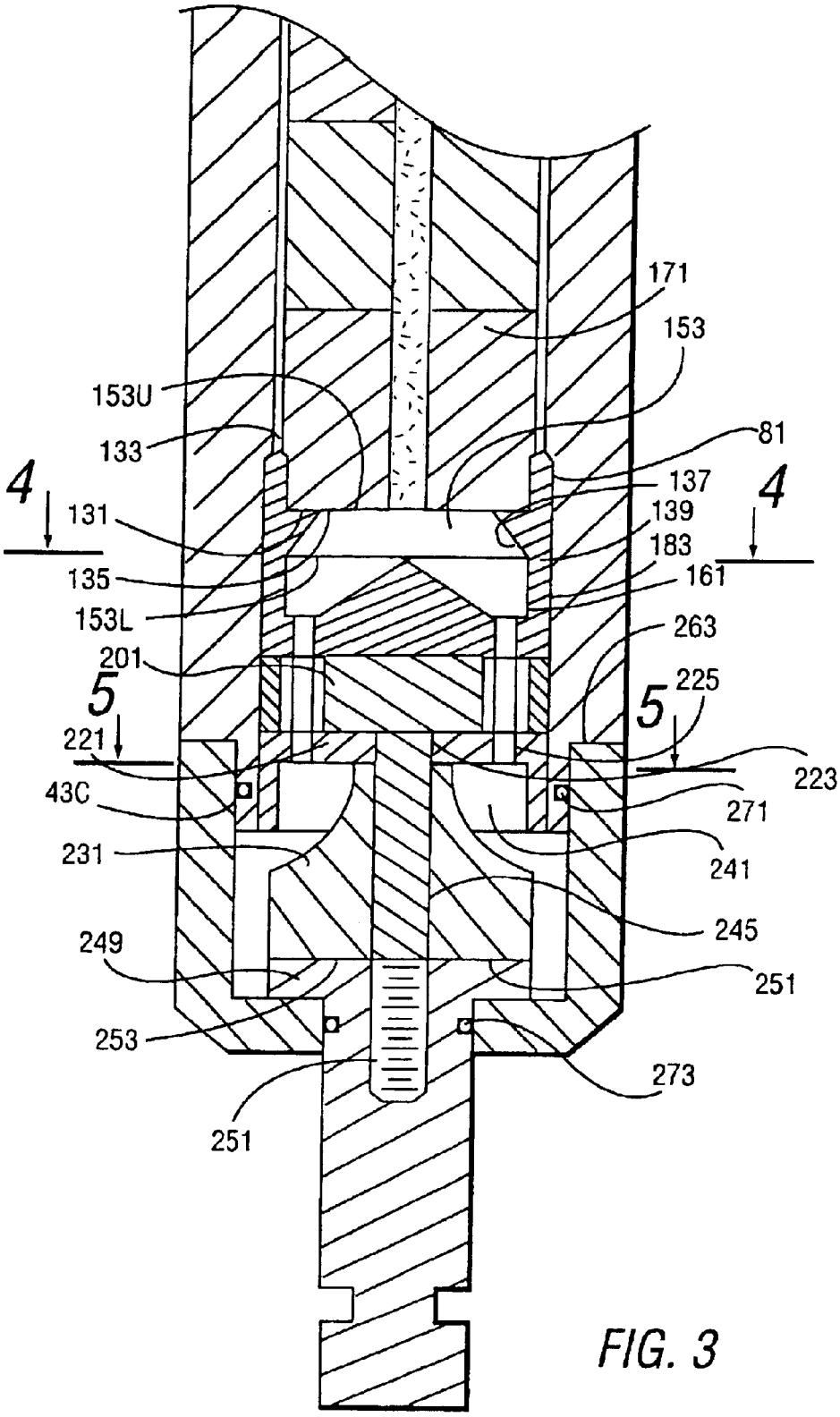
FIG. 3 is a cross-section of the lower end of the apparatus of FIGS. 1 and 2A and 2B.
Figure 4:
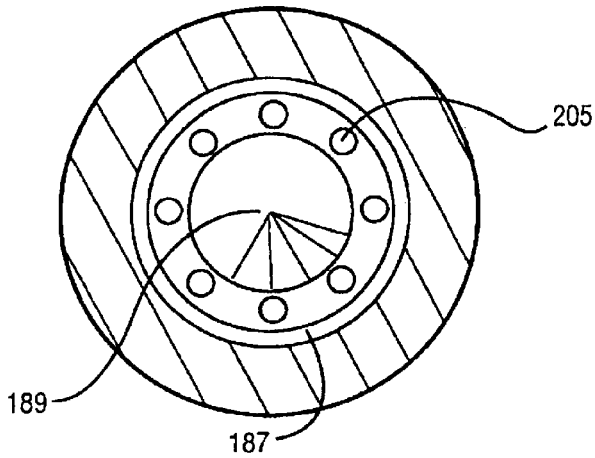
FIG. 4 is a view of FIG. 3 as seen along lines 4—4 thereof.
Figure 7:
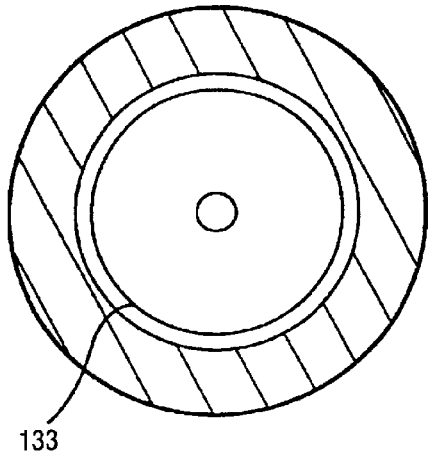
FIG. 7 is a view of FIG. 6 as seen along lines 7—7 thereof.
Figure 5:
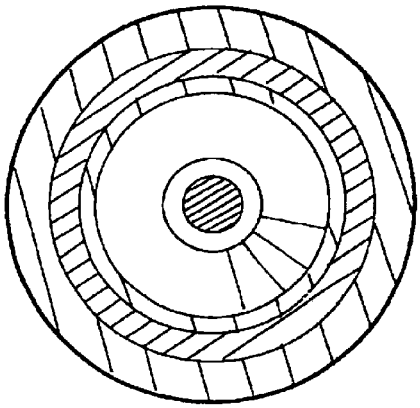
FIG. 5 is a view of FIG. 3 as seen along lines a 5—5 thereof.
Figure 8:
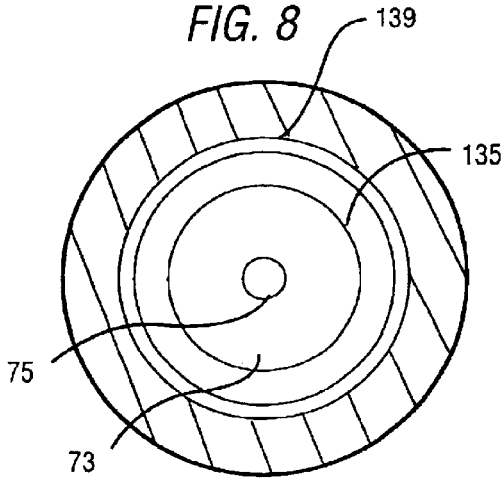
FIG. 8 is a view of FIG. 6 as seen along lines 8—8 thereof.
Figure 6:
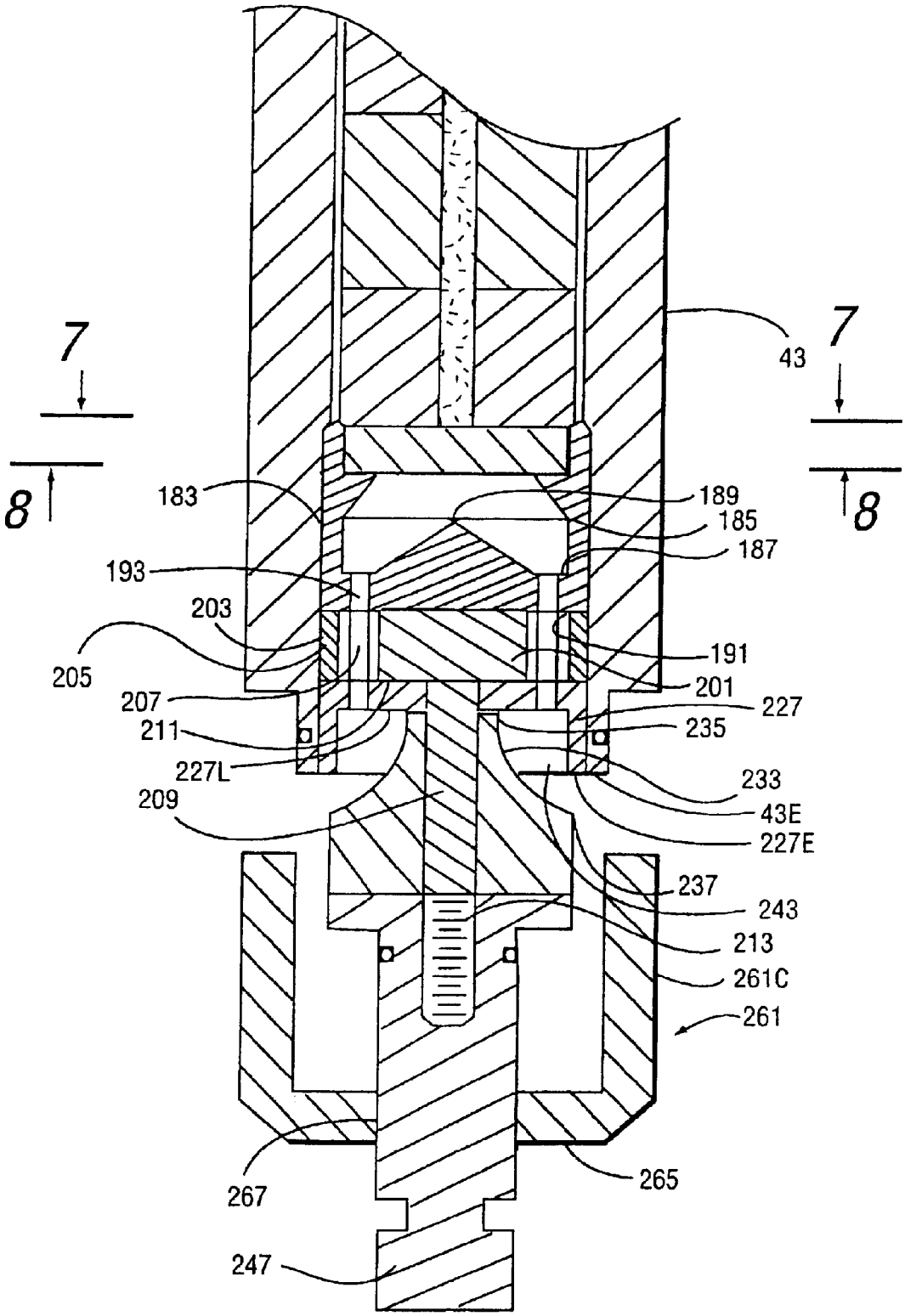
FIG. 6 is a cross-section of the lower end of the apparatus of FIGS. 1, 2A, and 2B with the sleeve in an open position.

Also provided is a metal sleeve 261 which is initially located in an upper closed position as shown in FIG. 3 and is movable by the hot gases to an open position as shown in FIG. 6. The cylindrical wall 43 has an inward extending shoulder 263 which extends to a smaller cylindrical surface 43C. The sleeve 261 comprises a cylindrical portion 261C. In the closed position, the upper end of the cylindrical portion 261C fits against the shoulder 263 and the surface 43C. The lower end of the sleeve 261 has an inward extending portion 265 with a circular aperture 267 formed therethrough through which the anchor connector 247 extends. Members 271 and 273 are O-rings.

In the operation of the system, the uphole switch 67 is closed to apply an electrical output to the resistor 113 which generates enough heat to ignite the combustible material 75 and pellets 71 which generate a flame and hot gases which flow through the plurality of opening 135 of the support 81 into the chamber or cavity 153 which promotes mixing of the gases prior to flow through the aligned hole sets 193, 207, 225. This prevents the hole sets 193, 207, 225 from becoming plugged. The flame and hot gases then flow out of the hole sets 193, 207, 225 into the annular cavity 241 formed between diverter surface 231, the bottom side of the retainer 221 and the inside of wall 227 and then out of the gap 243 formed between the ends 227E and 41E of the walls 227 and 41 and the large circumferential edge 237 of the diverter. The flame and hot gases push the sleeve 261 downward to a lower open position allowing the flame and hot gases flow out of the gap 243 formed between the diverter edge 237 and the ends 227E and 43E of the walls 27 and 43 radially outward to cut the pipe or tubing in the borehole. In the cavity 241, the pressure of the flame and hot gases builds up before leaving the gap 243 resulting in a more even distribution of the hot gases around the circumference of the diverter edge which results in a more even severing of the pipe or tubing in the borehole around its circumference.

Figure 10:
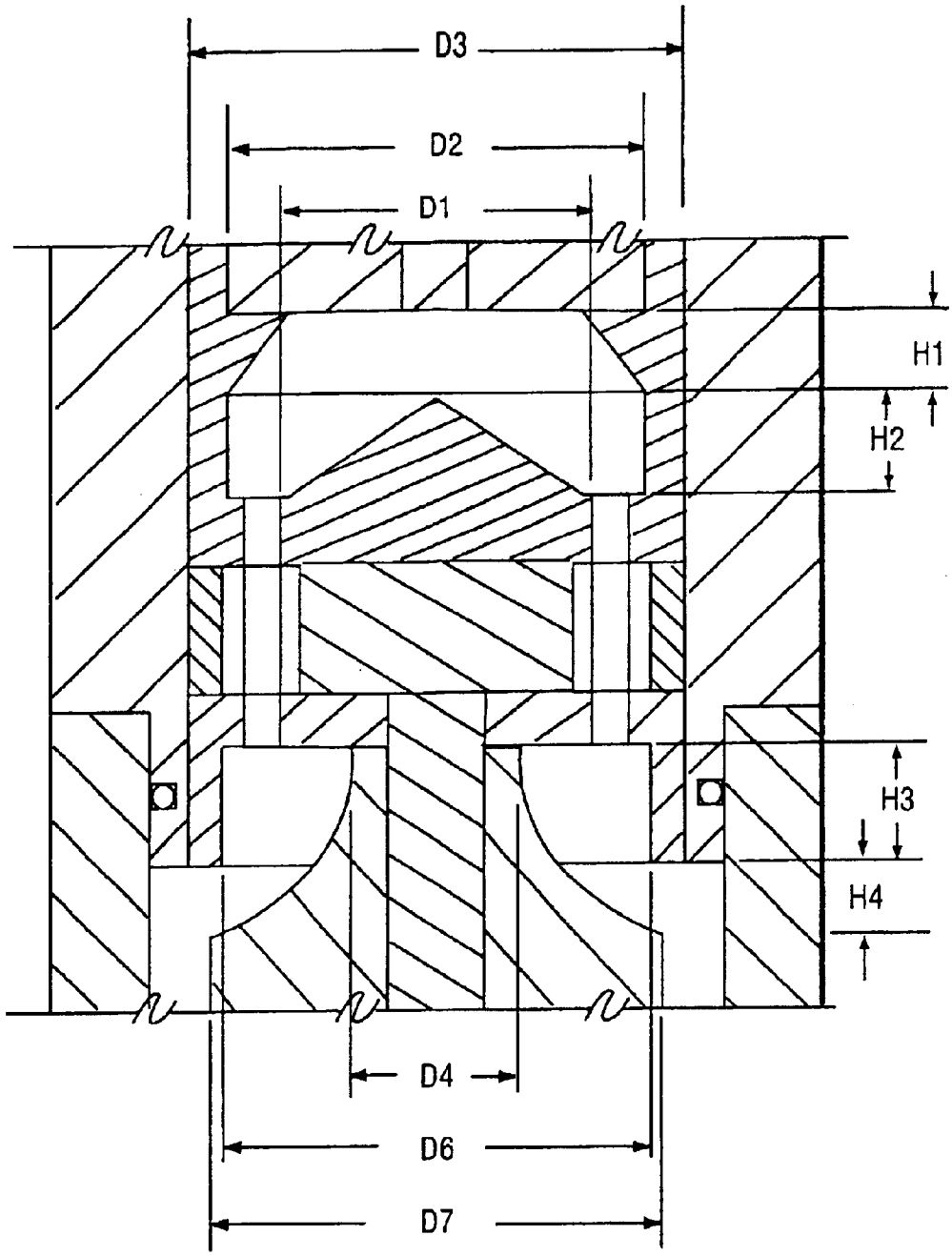
FIG. 10 is a partial cross-section of the apparatus similar to that of a portion of FIGS. 3 and 6.

Eight hole sets 193, 207, 225 are shown, however, the number of hole sets may vary from 6 to 24 or more. In one embodiment, for severing a pipe or tube having an inside diameter of 2⅜ inches, the outside diameter of the tool 21 may be 1½ inches. In this embodiment, and referring to FIG. 10, the diameters of D1, D2, D3, D4, D6, and D7, may be ⅝, 1, 1⅛, ⅝, 1, 1 7/16 inches respectively, and the heights H1, H2, H3, and H4 may be ⅜, ¼, ⅜, ⅛ inches respectively.

The height H4 of the gap 243 may be increased or decreased by using diverter 231 having a different curved surface 233.

FIG. 11 shows a cross-sectional view of the thermal generator 301 of the present invention in accordance with a preferred embodiment. The thermal generator 301 of FIG. 11 is substantially similar to the thermal generator 101 of FIG. 9, with the exception of the electrical contact 345. The thermal generator will now be described in more detail.

The thermal generator 301 includes a body 303, a flammable material 327 and a resistor 313. The thermal generator serves as an ignition device for other components of a downhole tool.

The body 303 is made of metal and has, referring to the orientation in FIG. 11, an upper end 329 and a lower end 331. A passage, or opening, 304 extends through the body 303 between the upper and lower ends 329, 331. Thus, the body is tubular. The upper and lower ends 329, 331 of the passage are provided with counterbores 333, 335 which, counterbores have internal threads 311, 323. Near the upper end 329 is an exterior shoulder 337 that extends around the circumference. Between the shoulder 337 and the lower end 331 is a circumferential groove for receiving the o-ring 325.

The upper end 329 receives an electrical contact assembly 339 that forms a plug. The bottom end 33 receives a plug, 321. The body thus has a cavity, 340, formed by the passage 304 that is between the upper and lower end plugs 339, 321. The cavity 340 receives the flammable material 327 and resistor 313.

The plug 339 at the upper end has an electrical member 305 that, in the preferred embodiment, is made of brass. The member 305 has a lower shoulder 341. An annular insulator 309 fits around the member 305 and onto the shoulder 341. A snap, or retaining ring, 343 secures the insulator in place. A banana plug 345 extends up from the member 305 and a lead 347 extends down. A threaded ring 307 contacts a shoulder on the insulator and is received by the upper end counterbore 333 to secure the contact and insulator within the counterbore. The member 305 is electrically insulated from the body 303.

The bottom plug 321 has threads which mate with the threads in the bottom counterbore 335. The bottom plug 321 has an axial passage 324 therethrough. Thus, the flammable material 327 can communicate with the exterior of the body through the passage. A cover 347, such as foil, covers the inside end of the bottom plug passage 324. The foil is easily penetrated when the thermal generator is ignited.

The flammable material 327 is solid and is contained in the cavity 340. The flammable material is a thermite, or modified thermite, mixture. The mixture includes a powdered (or finely divided) metal and a powdered metal oxide. The powdered metal includes aluminum, magnesium, etc. The metal oxide includes cupric oxide, iron oxide, etc. In the preferred embodiment, the thermite mixture is cupric oxide and aluminum. When ignited, the flammable material produces an exothermic reaction. The flammable material has a high ignition point and is thermally conductive. The ignition point of cupric oxide and aluminum is about 1200° F. Thus, to ignite the flammable material, the temperature must be brought up to at least the ignition point and preferably higher. It is believed that the ignition point of some thermite mixtures is as low as 900° F.

The resistor 313 is located in the cavity 340 and is electrically connected between the conductive plug 347 and the body 303. In the preferred embodiment, the resistor 313 is 50 ohms and is wire wound. The resistor 313 is coated with enamel, ceramic, or some other non-reactive coating. Many substances, when heated to the high temperatures necessary to ignite the flammable material, will react with the flammable material and create a thermal insulation around the resistor, thereby degrading the ignition. With the resistor 313 of the present invention, however, the non-reactive coating allows the heat generated by the resistor to pass into the flammable material for reliable and predictable ignition.

The resistor 313 is commercially available. In the preferred embodiment, the resistor is between 2–3¼ watts. If the resistor is too small, it may not generate enough heat to reach the ignition temperature of the flammable material. If the resistor is too large, the voltage load required to produce a sufficient heat could be too much for the equipment, which equipment is designed for the downhole environment.

To assemble the thermal generator 301, the electrical plug assembly 339 and the resistor 313 are inserted into the passage 304. The resistor is electrically connected to the body 303 and the lead 347. Then, the flammable material 327 is placed into the cavity 340 through the lower end and the lower plug 321 is inserted. The thermal generator 301 is ready for use.

Figure 12:
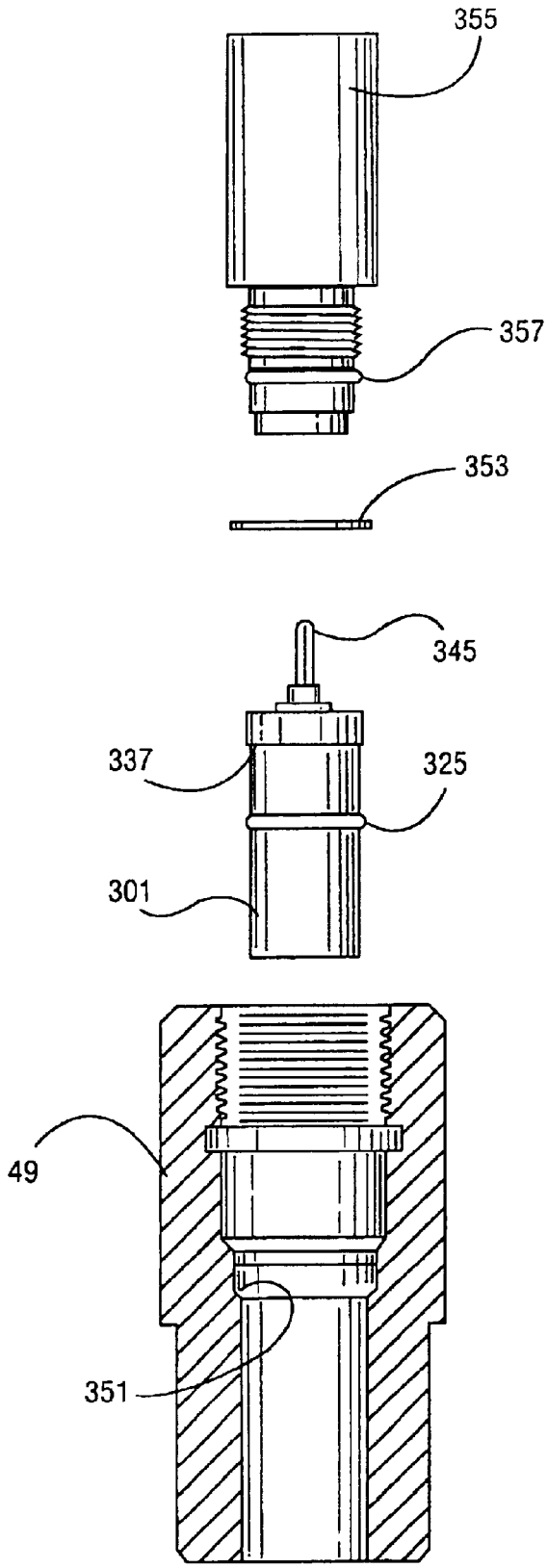
FIG. 12 is a partially cross-sectional, exploded view of a sub-assembly with the thermal generator of FIG. 11.

FIG. 12 illustrates a typical application of the thermal generator 301. The thermal generator is located within a thermal generator sub 49. The shoulder 337 of the body contacts an inner shoulder 351 of the sub 49. A snap ring 353 on the top of the upper end secures the thermal generator in place.

Another sub 355, or isolation sub, is received into the upper end of the thermal generator sub 49. The lower end of the insulation sub has an electrical receptacle for electrically mating with the banana plug 345. A conductor (not shown) extends to the top of the insulation sub, and ultimately to the wireline 53 (FIG. 1).

The banana plug 345 is located between two o-rings 325, 357 in a sealed chamber. One of the o-rings is on the thermal generator 301, while the other o-ring is on the lower end of the isolation sub 355. The o-rings seal against the thermal generator sub 49, and keeps the banana plug 345 and its electrical connection dry of well fluids.

In use, electrical current is provided from the surface via the wireline 53. Current flows through the banana plug 345, through the resistor 313 and through the body 303 ground back into the wireline to the surface. A large current is provided to the resistor over a relatively long period of time to initiate the flammable material 327. In general, the amount of current required is between 0.75–1.5 amps. If too little, or too much, current is used, the resistor will be damaged before the flammable material becomes ignited. In the preferred embodiment, a one-amp current is provided for a minute or more. Thus, about 70 watts of power is required to initiate the flammable material. Once the flammable material is initiated, an exothermic reaction produces hot gases, which ruptures the foil 347 and escapes through the lower plug 321 and into the remainder of the tool.

FIG. 13 shows the thermal generator 301 used in conjunction with detonating cord 361. The thermal generator 301 produces a flame output which, by itself, is insufficient to reliably ignite the detonating cord 361. Thus, an intermediate sub 363 is used between the thermal generator sub 49 and the detonating cord tool 365. The intermediate sub 363 has an axial passage therethrough. At the upper end of the passage is a pyrobooster 367 or "flash" detonator. Below that is a primary charge 369 and below that is a bulk explosive 371. When ignited, the bulk explosive produces an explosion sufficient to ignite the detonating cord. In the detonating cord tool, a conventional booster charge 373 is interposed between the bulk explosive 371 and the detonating cord 361.

When the thermal generator 301 is initiated, the flame output initiates the materials 367, 369, 371 in the intermediate sub 363, which then initiate the booster charge 373 and the detonating cord 361.

FIG. 14 shows the thermal generator 401 in accordance with another embodiment. In slickline applications electrical power from the surface is unavailable to the downhole tool, as the wireline is a mechanical cable, not an electrical one.

The battery power supply is thus located on the tool. Because of the limitations on power, a large resistor is not used. Instead, a modified glow plug is used, having a coil 403 of nichrome wire or some other alternative type wire.

Figure 15:
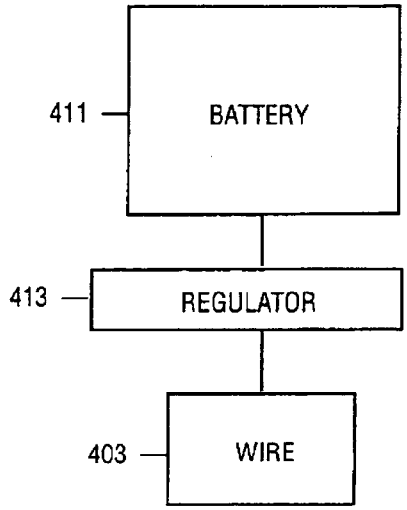
FIG. 15 is a block diagram of the electric circuit used with the thermal generator of FIG. 14.

An electrical circuit (see FIG. 15) is used to regulate the voltage provided to the wire, so as to prevent the wire from heating up to the point breaking. Of course, breaking wire cuts the circuit and produces a failure in attempting to initiate the thermal generator. The battery 411 provides electrical power to the regulator 413. The regulator provides a regulated voltage to the wire 403 so that the electrical continuity of the wire will be maintained. Of course, once the thermite is ignited, the continuity of the wire will be broken, but by then the thermite reaction will be self-sustaining.

Electrical power is provided to the wire over a prolonged period of time, for example, 60 seconds or so, wherein the wire heats to a sufficient temperature to initiate the flammable material. The amount of power is between 25–75 watts, with 50 watts used in the preferred embodiment.

The thermal generator of the present invention has several advantages over the prior art. The thermal generator is safe to use in that the risk of accidental initiation is quite low. Consequently, the device can be shipped or transported in relative safety and with fewer constraints than prior art black powder devices. The device can be exposed to high power radio frequency signals and still not be initiated. This is because the device requires a sustained voltage and current for a prolonged period of time. Also, the physical length of the thermal generator is short compared to other initiators. The design allows the thermal generator to be used in an application of up to 500° F. ambient. The provision of o-rings around the electrical contact further increases reliability. In addition, the use of the flammable material eliminates slag buildup in the tool and ensures greater reliability.

The foregoing disclosure and the showings made of the drawings are merely illustrative of the principles of this invention and are not to be interpreted in a limiting sense.

What is claimed is:

1. An ignition device for a downhole tool, comprising:

a) a body having a cavity therein;

b) a thermite material in the cavity;

c) a resistive element located inside the cavity and having an outer surface in contact with the thermite material, the resistive element outer surface being non-galvanic at an ignition temperature of the thermite material, wherein the thermite material initiates an exothermic reaction when the resistive element is heated by a current of 0.75–1.5 amps.

2. The ignition device of claim 1 wherein the resistive element comprises a wire-wound resistor with a coating of ceramic.

3. The ignition device of claim 1 wherein the resistive element comprises a wire-wound resistor with a coating of enamel.

4. The ignition device of claim 1 wherein the resistive element comprises a length of nickel-chromium wire.

5. The ignition device of claim 1 wherein the thermite material comprises cupric oxide and aluminum.

6. The ignition device of claim 1 wherein the thermite material comprises iron oxide and aluminum.

7. The ignition device of claim 1 wherein the body has first and second ends, with the first end having an electrical plug and the second end having an opening that communicates with the cavity and the thermite material therein.

8. An ignition assembly for a downhole tool, comprising:

a) a first sub having first and second ends and a passage extending between the first and second ends;

b) an ignition device located in the passage, the ignition device having a thermite material and a resistive element located so as to be in contact with the thermite material, and having an electrical plug extending toward the first sub first end;

c) a second sub having an electrical receptacle, the second sub located in the passage so that the electrical receptacle receives the electrical plug to form an electrical connection;

d) a first seal between the ignition device and the first sub and second seal between the second sub and the first sub, the electrical connection located between the first and second seals.

9. The ignition assembly of claim 8 wherein the electrical plug is a banana plug.

10. The ignition device of claim 8, further comprising:

a) a length of detonating cord located adjacent to the first sub second end;

b) at least one intermediate charge interposed between the detonating cord and the first sub second end.

11. A method of assembling an ignition assembly for use in a downhole tool, comprising the steps of:

a) providing an electrical ignition device having a first end with an electrical plug and a second end with an aperture for the exit of ignition products;

b) providing a seal in contact with and around the ignition device;

c) inserting the ignition device into a first sub so as to form a first seal between the ignition device and the sub;

d) securing the ignition device within the first sub;

e) providing a second sub with an electrical receptacle;

f) inserting the second sub into the first sub so that the receptacle receives the plug and so as to form a second seal between the second sub and the first sub.

12. The method of claim 11 wherein the step of inserting the second sub into the first sub further comprising the step of screwing the second sub into the first sub.

13. A method of igniting an ignition device on a downhole tool, comprising the steps of:

a) lowering a tool containing the ignition device downhole on a conductive wireline, the ignition device containing a thermite material having an ignition point of greater than 900° F.;

b) flowing, through the wireline, and into a resistive element in the ignition device, at least 25 watts of electrical power until the thermite material ignites.

14. An ignition device for use with a downhole tool, comprising:

a) a body having a cavity therein;

b) a thermite material in the cavity;

c) a high temperature resistive wire element located inside of the cavity and in contact with the thermite material;

d) a power supply electrically connected with the resistive wire element, the power supply providing a voltage that is regulated so as to maintain the continuity of the resistive wire element and providing an electrical power that is between 25 and 75 watts.

* * * * *